US008246483B2

(12) United States Patent
Garno

(10) Patent No.: US 8,246,483 B2
(45) Date of Patent: Aug. 21, 2012

(54) SINGLE-ARM GOLF CLUB

(76) Inventor: Jeff Garno, Altamonte Springs, FL (US)

( * ) Notice: Subject to any disclaimer, the term of this patent is extended or adjusted under 35 U.S.C. 154(b) by 176 days.

(21) Appl. No.: 12/609,632

(22) Filed: Oct. 30, 2009

(65) Prior Publication Data

US 2011/0105239 A1 May 5, 2011

(51) Int. Cl.
*A63B 53/14* (2006.01)

(52) U.S. Cl. ..... 473/300; 473/212; 473/227; 473/296

(58) Field of Classification Search ..... 473/212–214, 473/227, 239, 276, 282, 293–294, 296, 298, 473/300–303; 16/430
See application file for complete search history.

(56) References Cited

U.S. PATENT DOCUMENTS

| | | | | |
|---|---|---|---|---|
| 2,273,416 | A | 2/1942 | Norwood | |
| 3,874,668 | A | 4/1975 | Flege et al. | |
| 3,951,416 | A | 4/1976 | Koch | |
| 5,156,429 | A * | 10/1992 | Adams | 294/25 |
| 5,209,474 | A | 5/1993 | Voyer | |
| 5,470,073 | A | 11/1995 | Vasquez | |
| 5,616,087 | A | 4/1997 | Bothwell | |
| 6,110,054 | A | 8/2000 | Rodarte | |
| 6,148,483 | A * | 11/2000 | DeGraff | 16/430 |
| 6,190,266 | B1 | 2/2001 | Pamias | |
| 6,199,245 | B1 * | 3/2001 | Blessing | 16/430 |
| 6,343,997 | B1 | 2/2002 | Allen | |
| 6,350,206 | B1 | 2/2002 | Lambert | |
| D468,910 | S * | 1/2003 | Carman et al. | D4/138 |
| 2007/0105638 | A1 | 5/2007 | MacDermott et al. | |

* cited by examiner

*Primary Examiner* — Stephen L. Blau
(74) *Attorney, Agent, or Firm* — Mayback & Hoffman, P.A.; Gregory L Mayback; Thomas Bethea

(57) ABSTRACT

A golf club includes a shaft with a length, a distal end, and a proximal end separated from the distal end by the length. A hand grip is disposed along the length and an arm-securing attachment is coupled to the proximal end of the shaft and has a substantially spiral-shape with a spiral direction away from the proximal end of the shaft. A club face is coupled to the distal end of the shaft.

16 Claims, 4 Drawing Sheets

SINGLE-ARM GOLF CLUB

FIELD OF THE INVENTION

The present invention relates generally to a golf club that is used with only a single arm, and more particularly relates to a golf club with a spiral attachment on an upper portion for securing the golfer's arm and a grip portion along the club's mid-section for securely gripping the club with the golfer's hand.

BACKGROUND OF THE INVENTION

The game of golf is a highly popular source of exercise and recreation and is enjoyed by persons of all ages and levels of skill. To become proficient in the golf, it is necessary for the golfer to develop a precision swing so that he or she can accurately strike the ball in order to propel the ball in the desired direction, speed, and line of flight toward the hole. Much has been written over the years on developing a good golf swing. Many professional teachers spend their careers teaching persons to develop a proper golf swing. Numerous video lessons are also available and are directed to teaching a golfer how to develop a precise golf swing.

One of the main reasons a golf swing is difficult to develop is because there are so many fulcrum points on the human body when gripping a club with both hands. These fulcrum points must all work in conjunction with each other, which creates a very complex mechanical model. FIG. 1 shows a golfer 100 preparing to swing a club 102. Because both of the golfer's hands are being used to grip the club 102, when the golfer 100 swings, his two shoulders, two elbows, two wrists, two hips, two knees, two ankles, and spine all move and effect the golfer's stroke. Each of these pairs of pivot points come into play, as well as a combination of them all, making the golf swing incredibly complicated. In addition, because the stance for a two-hand swing places the golfer 100 sideways from the hole, the hole can only be seen in the golfer's peripheral view.

Several one-arm golf clubs have been made that allow the golfer to grip the shaft of the club with a hand while providing measures for bracing the club against a second portion of the golfer's arm. Because only one arm is used, these clubs remove several of the above-identified fulcrum points, thereby simplifying the mechanics of the swing. In addition, swinging with only a single arm allows the golfer to directly face the hole and swing with an arm movement that more resembles a natural bowling-type motion. However, none of the prior-art designs provides a one-arm club with a solid coupling between the club and the golfer's arm.

Therefore, a need exists to overcome the problems with the prior art as discussed above.

SUMMARY OF THE INVENTION

Briefly, in accordance with the present invention, disclosed is a golf club having a grip portion with a distal end and a proximal end opposite the distal end a club head mechanically coupled to the distal end of the grip portion and an arm-securing portion mechanically coupled to the proximal end of the grip portion and having a substantially spiral-shape with a spiral direction away from the grip portion.

In accordance with another feature, an embodiment of the present invention includes a shaft connecting the grip portion to the arm-securing portion.

In accordance with a further feature of the present invention, the shaft has a longitudinal axis and the arm-securing portion comprises a proximal end, a distal end opposite the proximal end and adjacent the grip portion, and a generally increasing width running from the distal end to the proximal end, the generally increasing width measured in a dimension parallel to the longitudinal axis of the shaft.

In accordance with yet another feature of the present invention, the arm-securing portion is removably attached to the shaft.

In accordance with an additional feature of the present invention, the arm-securing portion includes an outwardly spiraling shape with a generally increasing spiral diameter In accordance with a further feature of the present invention, he grip portion is shaped as a negative mold of a hand.

In accordance with another feature of the present invention, the shaft has a longitudinal axis and the arm-securing portion includes a proximal end, a distal end opposite the proximal end and adjacent the grip portion, and a generally increasing width running from the distal end to the proximal end, the generally increasing width measured in a dimension parallel to the longitudinal axis of the shaft.

In accordance with yet another embodiment, the present invention includes a golf club with a shaft that has an extent, a distal end, and a proximal end separated from the distal end by the extent. A hand grip is disposed along the extent, an arm-securing attachment is coupled to the proximal end and has a substantially spiral-shape with a spiral direction extending away from the proximal end, and a club face coupled to the distal end.

Although the invention is illustrated and described herein as embodied in a single-arm golf club, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an", as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the club's shaft.

BRIEF DESCRIPTION OF THE DRAWINGS

The accompanying figures, where like reference numerals refer to identical or functionally similar elements throughout the separate views and which, together with the detailed description below, are incorporated in and form part of the specification, serve to further illustrate various embodiments and to explain various principles and advantages all in accordance with the present invention.

DETAILED DESCRIPTION

The present invention provides an ergonomic golf club that can be accurately used with a single arm, thereby reducing many points of potential error present during a traditional two-arm golf swing. As is described below, the invention can be provided in many embodiments, each forming a solid bond between the golfer's arm and the inventive golf club.

Figure 1:
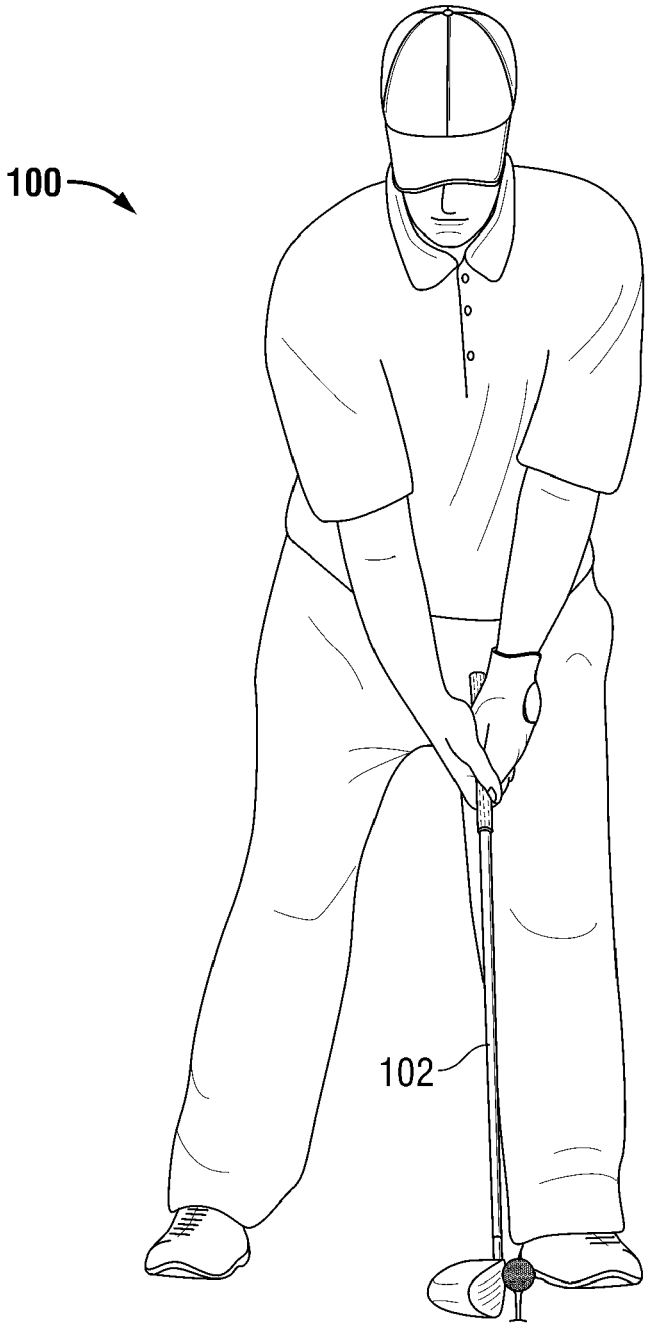
FIG. 1 is a perspective front view of a golfer in a two-armed swinging stance.
Figure 2:
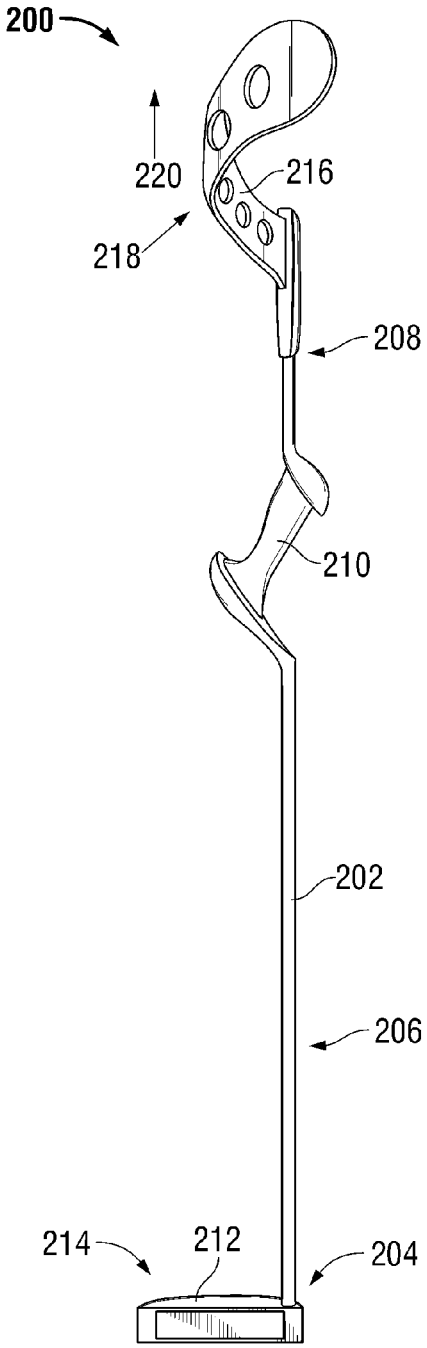
FIG. 2 is a side elevational view of a one-arm golf club in accordance with the present invention.

Referring now to FIG. 2, one embodiment of the present invention is shown. FIG. 2 illustrates several advantageous features of the present invention, but, as will be described below, the invention can be provided in several shapes, sizes, combinations of features and components, and varying numbers and functions of the components. In this first embodiment of FIG. 2, the inventive club 200 includes a shaft 202 with a distal end 204, a length or extent 206, a proximal end 208 that is opposite the distal end 204 and separated from the distal end 204 by the length 206. An ergonomic hand grip 210 is disposed along the length 206. A club face 212 is shaped onto a club head 214 and is coupled to the distal end 204 of the club 200. The club head 214 can be, for instance, a putter, but the present invention is in no way limited to any particular type or shape of club head 214 or club face 212.

Figure 3:
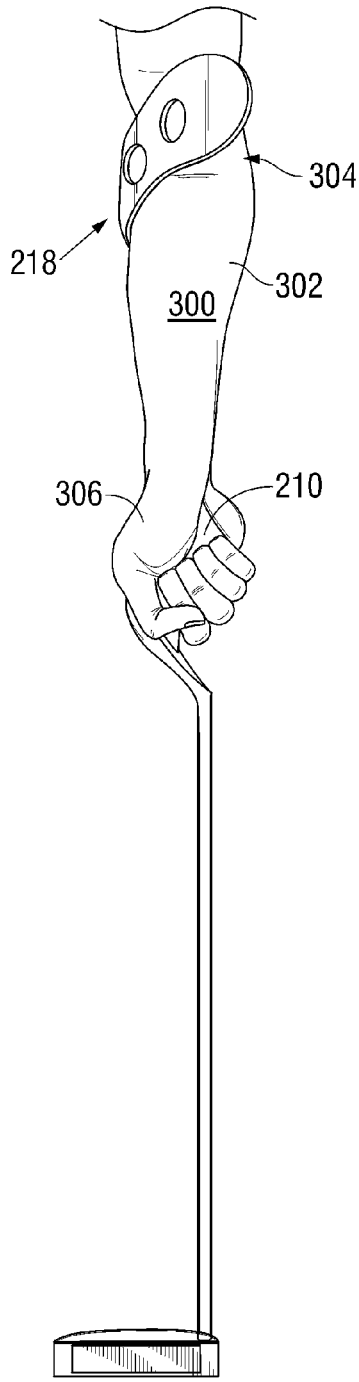
FIG. 3 is a side elevational view of an arm secured by the one-arm golf club of FIG. 1 in accordance with the present invention.
Figure 5:
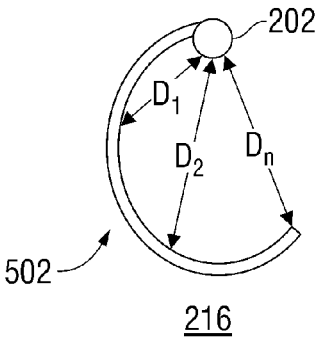
FIG. 5 is a top plan view of the arm-securing attachment of the one-arm golf club of FIG. 1.

At the proximal end 208 of the shaft 202 is an arm-securing attachment 216. The arm-securing attachment 216 has a substantially spiral-shape 218, which, in the particular embodiment shown, is in a spiral direction 220 generally away from the proximal end 208 of the shaft 202. The term "generally away from," as used here, refers to a longitudinal direction as shown by the arrow 220 and not a radially outward direction, although, as shown in FIG. 5, the spiral shape 218 expands radially outwardly as well. The upwardly spiral shape advantageously couples the club 200, as shown in FIG. 3, to a golfer's arm 300. FIG. 3 shows that the spiral shape 218 advantageously wraps around the golfer's forearm 302, up past the elbow area 304, and provides a solid connection to the golfer's arm 300. More specifically, the portion of the club 200 that is seen in FIG. 2 and obscured in FIG. 3 by the golfer's arm 300 makes securing contact with the hidden backside of the golfer's arm 300. The front portion of the arm-securing attachment 216 shown in FIG. 3 makes securing contact with the visible inside of the golfer's arm 300. The grip 210, securely held by the golfer's hand 306 secures the club and prevents the club from rotation or sliding down the golfer's arm. Advantageously, the inventive club 200 actually feels to the golfer as though the club 200 is an extension of the golfer's arm 300.

Figure 4:
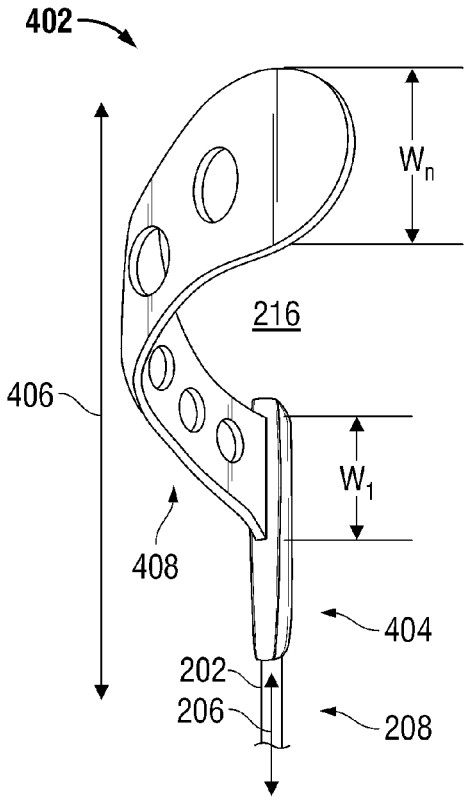
FIG. 4 is a fragmentary, enlarged, side elevational view of the arm-securing attachment of the one-arm golf club of FIG. 1.

FIG. 4 shows a fractured elevational view of the arm-securing attachment 216 in more detail. The arm-securing attachment 216 includes a proximal end 402, a distal end 404 opposite the proximal end 402, and a length 408 spanning between the proximal end 402 and the distal end 404. The distal end 404 couples to the proximal end 208 of the shaft 202. Although not required, in the particular embodiment shown in FIG. 4, the arm-securing attachment 216 has a generally increasing width $W_{1-n}$ running from the distal end 404 to the proximal end 402, where $W_1$ is less than $W_n$, and the width is measured in a dimension 406 that is parallel to the length 206 of the shaft 202 to which the arm-securing attachment 216 is attached. The increasing diameter shape 218 of the arm-securing attachment 216 is analogous to the shape of a beaver's tail, for example.

FIG. 5 shows a top-down view of one embodiment of the presently-inventive arm-securing attachment 216, where it can be seen that the arm-securing attachment 216 has a generally outwardly spiraling shape 502 with a generally increasing spiral diameter $D_{1-n}$, where $D_1$ is less than $D_2$ and $D_2$ is less than $D_n$.

Figure 6:
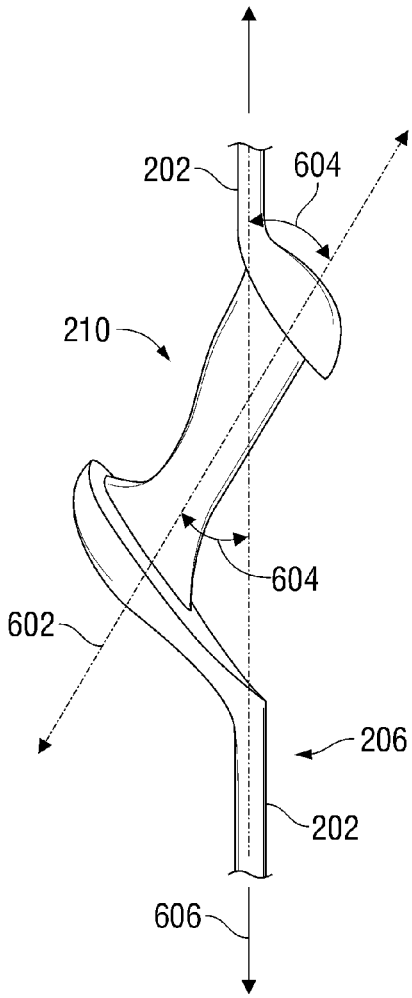
FIG. 6 is a fragmentary, enlarged, side elevational view of a grip portion of the one-arm golf club of FIG. 1.

FIG. 6 shows a fractured elevational view of the grip 210, which is provided along the length 206 of the shaft 202. Advantageously, the grip 210 is ergonomically molded from a negative mold (impression) of a hand, giving the grip 210 a natural feel to a golfer gripping the grip 210. As opposed to traditional clubs, where the grip is simply the rubberized upper end of the straight club shaft, the grip 210 of the present invention has a longitudinal axis 602 at a non-zero angle 604 from a longitudinal axis 606 of the shaft 202. The non-zero angle 604 provides a natural feel to the grip 210 when the club 200 is attached to the golfer's arm 300 because the angle 604, as shown in FIG. 3, is a natural position of the human wrist. The fixed grip angle and the arm-securing attachment 216 place the golfer's wrist at a fixed angle and remove yet another fulcrum point from the mechanics of the swing. The angle 604 is acute and is greater than zero (0) degrees and less than approximately 90 degrees.

As an additional feature, the grip 210 and the arm-securing attachment 216, according to embodiments of the present invention, can be coated in or formed from a soft coating that provides adequate gripping and comfort against the golfer's skin to adhere the grip to his arm 300. Known materials that can be used include foam rubber, grip paper, leather, silicon based materials, latex, or any other similar material.

In one embodiment, the arm-securing attachment 216 is of a material that can be custom formed around the golfer's arm. For example, at the first use, the user can apply heat to the arm-securing attachment 216, the heat placing it in a flexible state. Once sufficiently heated, the golfer can wrap it around his or her arm to provide the proper fit. Once properly sized, the golfer can allow the arm-securing attachment 216 to cool and harden. In another embodiment, the arm-securing attachment 216 can be made of a material that remains pliable regardless of temperature and can be molded by simply applying adequate pressure. There are many known materials that have this property.

Figure 7:
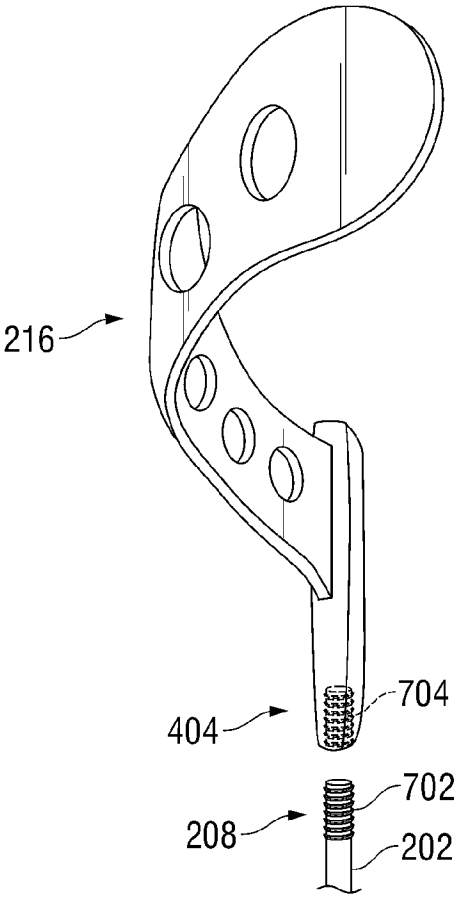
FIG. 7 is a fragmentary, enlarged, side elevational view of an arm-securing attachment and proximal portion of a shaft of the one-arm golf club of FIG. 1 with a threaded coupling junction.

In a further embodiment, as shown in FIG. 7, the club 200 is provided with measures for incrementally adjusting the length of the club 200. In one example, the proximal end 208 of the shaft 202 can be provided with exterior threads 702. The arm-securing attachment 216 is provided with corresponding interior threads 704 at its distal end 404. To alter the distance between the grip 210 and the arm-securing attachment 216, the user simply rotates the arm-securing attachment 216 with reference to the shaft 202 and the threads 702, 704 to cause the two elements to move laterally with relation to each other in a direction that is dependent on the direction of rotation.

Figure 8:
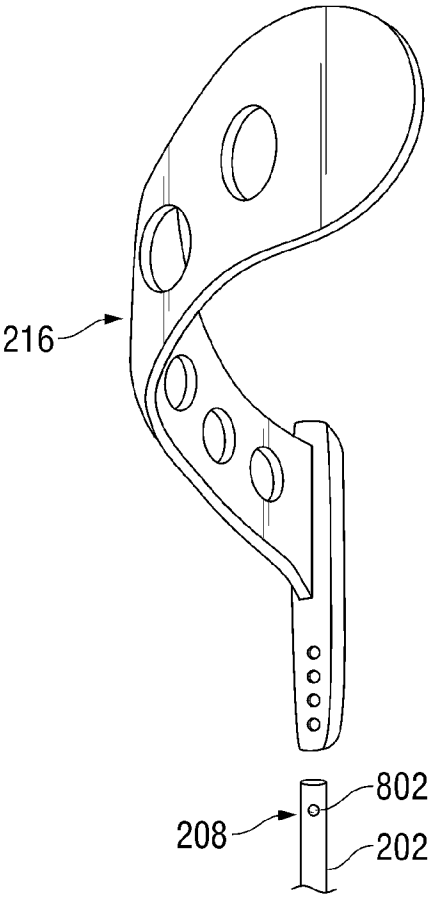
FIG. 8 is a fragmentary, enlarged side elevational view of an alternative embodiment of the arm-securing attachment and proximal portion of the shaft of FIG. 7 with a spring-loaded button junction.

In yet another embodiment, shown in FIG. 8, the proximal end 208 of the shaft 202 is provided with a button 802 for adjusting the distance between the grip 210 and the arm-securing attachment 216. The button 802 has a positive force, e.g. spring loaded, that pushes the button 802 in an outward direction from the shaft 202 and causes the normal state of the button to be one of extending beyond the outer surface of the shaft 202. The distal end 404 of the arm-securing attachment 216 is provided with a plurality of apertures $\mathbf{804}_{1\text{-}n}$, into which the button 802 is able to protrude when one of the apertures $\mathbf{804}_{1\text{-}n}$ is positioned over the button 802. By overcoming the positive force on the button 802, the distal end 404 of the arm-securing attachment 216 can be slipped over the proximal end 208 of the shaft 202, including the button 802. By allowing the button 802 to protrude through one of the apertures $\mathbf{804}_{1\text{-}n}$, the shaft 202 and the arm-securing attachment 216 will be locked at a fixed overall length of the club 200. Of course, the above-mentioned length-adjusting embodiments are merely exemplary and the present invention is in no way limited to threads or buttons. Any other measures of fixedly selecting a distance between the grip 210 and arm-securing attachment 216 can be utilized according to the present invention.

A single-arm golf club has been disclosed that greatly simplifies the mechanics of a golf swing by removing a great number of fulcrum points from the golfer's swing. In addition, swinging with a single arm allows the golfer to open his stance and face the hole, thereby providing a better view of the target to which the ball is being hit. The inventive club is securely attached to the golfer's arm, feeling to the golfer as though his or her arm has been naturally extended. The club can be used as a putter or any other club, such as a lob wedge, sand wedge, pitching wedge, gap wedge, ultra lob wedge, utility club, hybrid club, chipper, approach wedge, last wedge, and any other use which may be contemplated now or in the future which will aid the golfer in the betterment of the game.

What is claimed is:

1. A golf club comprising:

a grip portion having a distal end and a proximal end opposite the distal end;

a club head mechanically coupled to the distal end of the grip portion;

an arm-securing portion mechanically coupled with the proximal end of the grip portion and having a substantially spiral-shape with a spiral direction away from the grip portion the arm-securing portion comprising:

a proximal end;

a distal end opposite the proximal end and adjacent the grip portion; and a generally increasing width running from the distal end to the proximal end, the generally increasing width measured in a dimension parallel to the longitudinal axis of the shaft; and a shaft connecting the grip portion to the arm-securing portion, wherein the shaft has a longitudinal axis.

2. The golf club according to claim 1, wherein the arm-securing portion is removably attached to the shaft.

3. The golf club according to claim 1, wherein the club head has a shape of a putter.

4. The golf club according to claim 1, wherein the arm-securing portion comprises:

an outwardly spiraling shape with a generally increasing spiral diameter.

5. The golf club according to claim 1, wherein the grip portion is shaped as a negative mold of a hand.

6. The golf club according to claim 1, wherein:

the grip portion has a longitudinal grip axis at a non-zero angle with respect to the longitudinal axis.

7. The golf club according to claim 1, further comprising:

means for incrementally adjusting a distance between the arm-securing portion and the grip portion.

8. The golf club according to claim 1, further comprising:

a distance adjustment device having at least one incremental adjustment to change a distance between the arm-securing portion and the grip portion.

9. A golf club comprising:

a shaft having:

an extent;

a distal end; and a proximal end separated from the distal end by the extent;

a hand grip disposed along the extent;

an arm-securing attachment coupled to the proximal end and having a substantially spiral-shape with a spiral direction extending away from the proximal end, the arm-securing attachment comprising:

a proximal end;

a distal end opposite the proximal end of the arm-securing attachment and coupled to the proximal end of the shaft; and a width increasing from the distal end of the arm-securing attachment to the proximal end of the arm-securing attachment, an increase of the width measured in a dimension parallel to the extent of the shaft; and a club face coupled to the distal end.

10. The golf club according to claim 9, wherein the arm-securing attachment comprises:

a length having an outwardly spiraling shape with an increasing spiral diameter.

11. The golf club according to claim 9, wherein the hand grip is shaped as a negative mold of a hand.

12. The golf club according to claim 9, wherein the club face is a shape of a putter.

13. The golf club according to claim 9, wherein the arm-securing attachment is removably attached to the shaft.

14. The golf club according to claim 9, further comprising:

means for incrementally adjusting a distance between the arm-securing attachment and the hand grip.

15. The golf club according to claim 9, further comprising:

a distance adjustment device having at least one incremental adjustment to change a distance between the arm-securing attachment and the hand grip.

16. The golf club according to claim 9, wherein the hand grip is integral with the shaft.

* * * * *